US005172569A

United States Patent [19]

Schnurrer

[11] Patent Number: 5,172,569

[45] Date of Patent: Dec. 22, 1992

[54] CAM ARRANGEMENT FOR KNITTING MACHINES, ESPECIALLY CIRCULAR KNITTING MACHINES

[75] Inventor: Hans Schnurrer, Albstadt, Fed. Rep. of Germany

[73] Assignee: SIPRA Patententwicklungs-und Beteiligungsgesellschaft mbH, Albstadt, Fed. Rep. of Germany

[21] Appl. No.: 676,091

[22] Filed: Mar. 27, 1991

[30] Foreign Application Priority Data

Apr. 14, 1990 [DE] Fed. Rep. of Germany ..... 4012204

[51] Int. Cl.[5] ..... D04B 15/32

[52] U.S. Cl. ..... 66/8; 292/115; 292/155; 66/57

[58] Field of Search ..... 292/95, 96, 115, 155; 66/8, 57

[56] References Cited

U.S. PATENT DOCUMENTS

| | | | |
|---|---|---|---|
| 1,026,051 | 5/1912 | Rodatt | 292/115 |
| 1,148,871 | 8/1915 | Steber | 66/8 |
| 1,616,106 | 2/1927 | Bourgon | 292/96 X |
| 1,664,576 | 4/1928 | Stuart et al. | 292/96 X |
| 3,670,526 | 6/1972 | Martinetz | 66/57 X |
| 3,780,539 | 12/1973 | Mishcon | 66/57 X |
| 3,848,432 | 11/1974 | Mishcon et al. | 66/57 X |
| 4,798,064 | 1/1989 | Elsässer et al. | 66/57 |

FOREIGN PATENT DOCUMENTS

| | | | |
|---|---|---|---|
| 318318 | 9/1929 | United Kingdom | 292/96 |
| 376701 | 7/1932 | United Kingdom | 292/95 |
| 396016 | 7/1933 | United Kingdom | 292/96 |

*Primary Examiner*—Werner H. Schroeder
*Assistant Examiner*—John J. Calvert
*Attorney, Agent, or Firm*—Michael J. Striker

[57] ABSTRACT

The cam arrangement for a knitting machine has a first support in the form of a cam support (11) and at least one second support in the form of a segment (14) and at least one cam part (16) mounted on the segment. For rapid fixing of the segment on the cam support there serves a fixing device (31), which includes a first claw (32) associated with the cam support and a tightening device associated with the segment (14). In accordance with the invention the tightening device consists of a coupling pin (36) with a threaded section (37), a second claw (33) fitted thereon and cooperating with the first claw (32) and a tightening element (38) screw-connected with the threaded section (37) and mounted rotatably on the associated segment (14) (FIG. 2).

14 Claims, 3 Drawing Sheets

CAM ARRANGEMENT FOR KNITTING MACHINES, ESPECIALLY CIRCULAR KNITTING MACHINES

BACKGROUND OF THE INVENTION

This invention relates to a cam arrangement for knitting machines, especially circular knitting machines with a first support in the form of a cam support, at least one second support in the form of a segment, at least one cam part mounted on the segment and at least one fixing device for interchangeable fixing of the one support on the other support, wherein the fixing device comprises a first claw associated with the first support and a tightening means including a coupling pin associated with the second support.

The segments of a knitting machine cam are as a rule fixed to the lock or cam support of the knitting machine with screws. Such an arrangement has the disadvantage that the exchange of the segments is very time consuming, because the screws must each be screwed through a number of rotations completely out of at least the lock or cam support.

It has therefore already been proposed to fix the segments on the lock support with the aid of quick connectors. In this respect a known lock arrangement of the kind initially referred to (DE-PS 1 938 891) has a coupling pin adapted to fit in a bore of the segment and having at one end a head bearing on the segment and at the other end a wedge surface. The lock support is provided with a claw-like recess, which has a clamping surface cooperating with the wedge surface. In the aligned state of the segment the two surfaces are opposed with a space therebetween. The fixing of the segment to the lock support is effected in simple manner in that the coupling pin of the segment is turned through about 180° and the wedge surface is thereby applied to the clamping surface, until a firm press fit is produced.

Such a quick connector had many advantages, because only half a turn of the coupling pin is necessary for fixing the segment to the lock body. Practical investigations in circular knitting machines have shown however that the known quick connector is largely unusable. Only small departures from tolerance lead to ineffective clamping or tightening and the unavoidable vibrations of a knitting machine in operation can lead to loosening of the clamping connection. Moreover the clamping forces do not act axially but outside the axis of the coupling pin, which can lead to poor clamping and also to canting of the coupled parts.

SUMMARY OF THE INVENTION

It is an object of this invention to design the cam arrangement mentioned above such that it effects a reliable fixing with high tightening forces.

A further object of this invention is to design the cam arrangement such that it is largely insensitive to tolerances and vibrations.

According to yet another object of this invention the cam arrangement should have the advantage of facilitating a rapid and simple fixing of the segment on the cam support.

To solve these and other problems, the coupling pin of the cam arrangement mentioned above has a second claw cooperating with the first claw and a threading section, and the tightening means of the cam arrangement further includes a tightening element screwed together with the threaded section and rotatably mounted in the associated support.

The invention brings with it the advantage that the clamping force is applied by the rotation of the tightening element on the threaded section of the coupling pin and does not therefore depend on the quality of a wedge surface or the like. Nevertheless the segment can be quickly mounted or dismounted, because only very few rotations are necessary in order to tighten the two claws together or free them from one another. Moreover the two claws can be so formed that the clamping or tightening force is applied substantially on the axis of the coupling pin.

BRIEF DESCRIPTION OF THE DRAWING

The invention will be explained in more detail below in conjunction with the accompanying drawings of an embodiment. These show.

DETAILED DESCRIPTION OF THE PREFERRED EMBODIMENT

Figure 1:
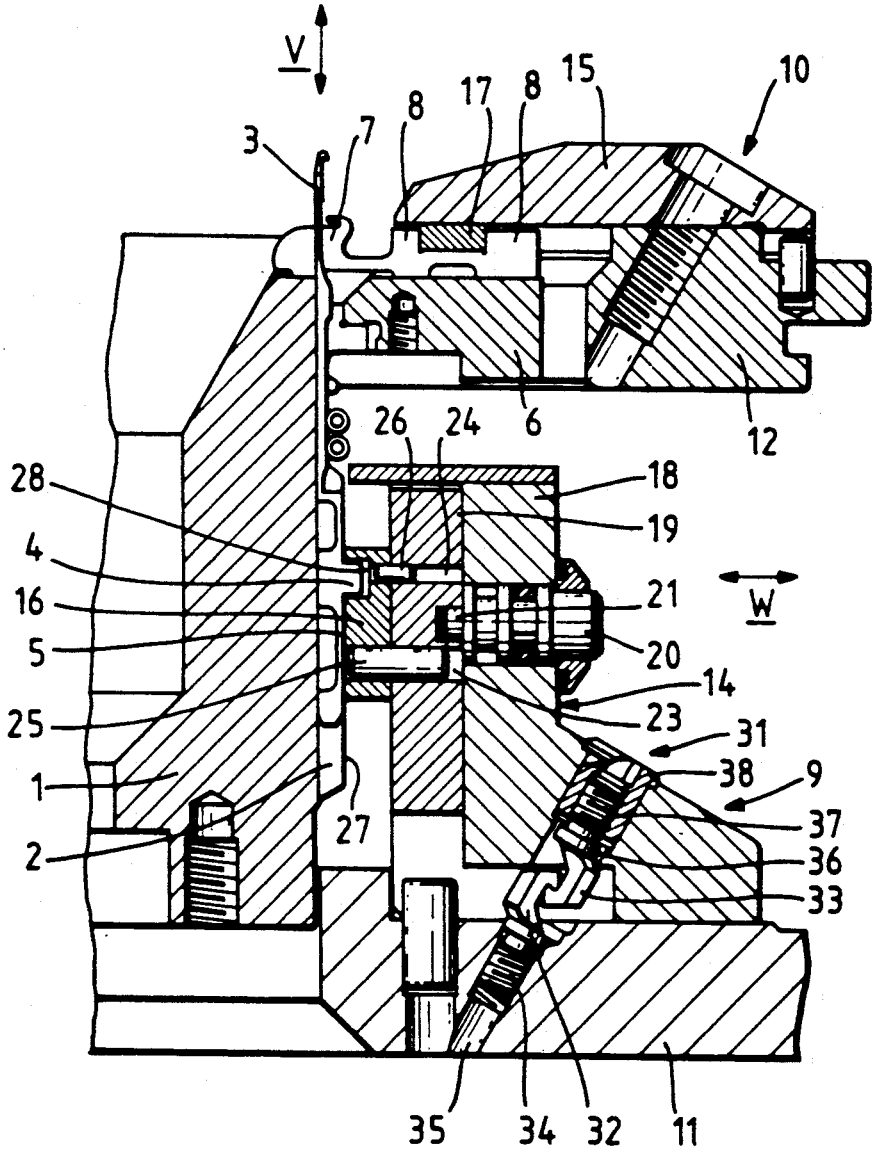
FIG. 1 a radial section through a circular knitting machine with a lock arrangement according to the invention.

FIG. 1 shows the details of a circular knitting machine necessary for an understanding of the invention, namely a first bed 1 in the form of a needle cylinder with vertically running lands 2, between which are slidably mounted knitting implements 3, here knitting needles, with butts 4 and shanks 5. Above the first bed 1 there is arranged a second bed 6 in the form of a sinker ring, which has radially extending lands, between which further knitting implements 7, here sinkers, with butts 8 are slidably mounted. To control the knitting implements 3, 7 there serve cam or lock arrangements 9 and 10, which each comprise a lock or cam support 11 and 12, at least one segment 14, 15 respectively fixed thereon and at least one lock or cam part 16, 17 respectively mounted thereon and acting in known manner on the butts 4, 8 of the knitting implements 3, 7. In this the beds 1, 6 and the lock arrangements 9, 10 are moved relative to one another in a direction which runs perpendicular to the longitudinal direction of the knitting implements 3, 7 and parallel to the respective bed 1, 6, i.e. perpendicular to the arrows v and w, while the knitting implements 3, 7 can simultaneously be advanced or retracted parallel to their longitudinal direction or be held in pass or miss position, according to the lock parts fitted.

The segment 14 of the lock arrangement 9 includes a positionally fixed part 18 mounted on the lock support 11 and a movably mounted part 19 carrying the cam part 16, in the form of a conventional slider adjustable parallel to the longitudinal direction of the knitting implements 3, which serves to adjust the draw depth or mesh length. For this adjusting operation there is provided an adjusting pin 20 projecting through the fixed part 18, which projects into the movable part 19 with an eccentric lug 21.

Circular knitting machines of this kind and their lock arrangements are generally known to the man in the art and are therefore not explained in more detail.

To simplify the mounting of the cam part 16 on the segment 14 the lock part 16 is preferably mounted on the movable part 19 solely by means of a sliding guide, i.e. without the use of fixing means in the form of a fixing screw or the like. If no alteration of the mesh length is necessary the cam part 16 is suitably fixed on a rigid part of the segment 14. The sliding guide consists in the embodiment of two cylindrical guide openings 23 and 24, which are formed in the part 19, with their axes arranged parallel to the arrow w and adapted to receive a peg 25, 26 each, which project from the rear side of the lock part 16. To this end the pegs 25, 26 are fitted e.g. in suitable bores formed in the rear side of the cam part 16 and attached firmly thereto by a press fit, adhesive or in other manner, or are made in one piece with the lock part 16. The bores formed in the cam part 16 can be through bores or blind bores.

The pegs 25, 26 have a cross-section which so corresponds to the cross-section of the guide openings 23, 24 that they are freely fitted therein with a sliding fit and can accordingly be moved to and fro in the direction of the arrow w. The fit between the guide openings 23, 24 and the pegs 25, 26 is so selected that the latter are mounted substantially without play in all directions perpendicular to the arrow w. Accordingly the guide openings 23, 24 and the pegs 25, 26 serve simultaneously as positioning elements which fix the position of the cam part 16 in the mounted state in all directions perpendicular to the arrow w, with the tolerances required by the knitting machine construction, so that no additional positioning elements are necessary.

However the cam part 16 is movably mounted in the direction of the bed 1 (arrow w) also in operation of the circular knitting machine. Possible sliding movements of the cam part 16 are limited on its rear side by its abutment with the part 19 or the segment 14 and on its front side by the free front faces 27 of the lands 2, insofar as the height of the lands 2 is greater than the height of the shanks 5 of the knitting implements 3. Alternatively it is also possible for the height of the shanks 5 to be somewhat greater than the height of the lands 2. In this case the possible sliding movement of the cam part 16 on its front side is limited by the shanks 5 of the knitting implements 3.

The length of the sliding guide for the cam part 16 in the direction of the arrow w is at least great enough for the cam part 16 to be guided with a sliding fit in the region of the lock play of as a rule up to about 0.25 mm, where the lock play corresponds to the spacing between the front faces 27 of the lands 2 or the shanks 5 and the front side of the cam part 16 facing these, when this part lies with its rear side on the part 19. Accordingly the predetermined positioning of the cam part 16 perpendicular to the arrow w cannot change, even when it slides to and fro during running operation. In fact the sliding guide is substantially longer in the practical form, preferably about 3 to 6 mm long, so that the lock parts 16 do not inadvertently fall out during mounting and demounting the carrier 14.

In relation to the control of the butts 4 by means of a lock path 28 formed in the front side of the cam part 16, the loose mounting of the lock part 16 is likewise not critical, because the height of the butts 4 and the depth of the lock path 28 can easily be so selected that the butts 4 are engaged in the lock path 28 in all possible positions of the cam part 16.

Alternatively the cam part 16 could naturally be fixed in conventional manner on the part 19 or segment 14 by means of a fixing screw and a locating pin.

To simplify the mounting of the segment 14 on the lock support 11, the lock arrangement according to FIG. 1 comprises a quick fastening device 31 in accordance with the invention. The quick fastening device 31 includes a first claw 32 associated with the lock support 11 and a second claw 33 associated with the segment 14. The first claw 32 is preferably fixed on a mounting pin 34, which is fixed in a bore 35 of the lock support, fast against rotation and axially immovable. On the other hand the second claw 33 is preferably fixed on a coupling pin 36 which has an section 37 provided with an external thread, on which is screwed a tightening nut 38 with a corresponding internal thread, mounted rotatably on the segment 14. For this the tightening nut 38 is preferably formed cylindrically on the outside and is mounted rotatably in a corresponding bore 39 of the segment 14 and, if desired, axially immovable. Thus the second claw 33 can be moved to and fro parallel to the axis of the coupling pin 36 between an open position shown in FIG. 2 and a clamping position apparent in FIG. 3 by rotating the tightening nut 38. Alternatively the coupling pin 36 could comprise an axial bore with an internal thread and there be instead of the tightening nut 38 a tightening screw with corresponding external thread rotatable into the internal thread.

Figure 5:
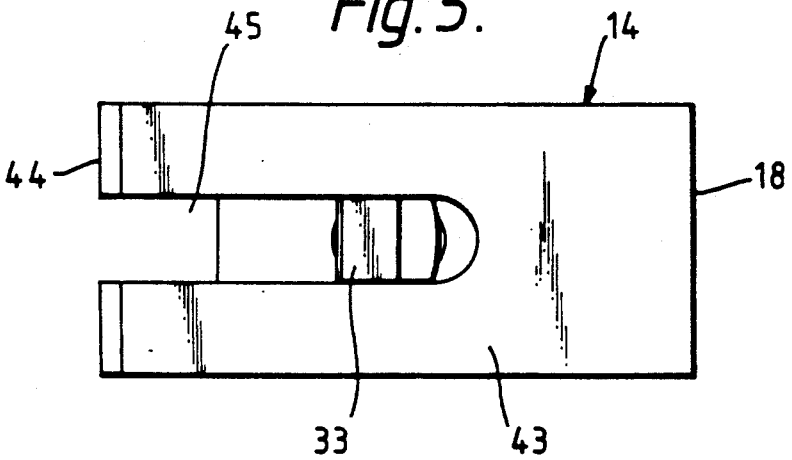
FIG. 5 the view from below of the segment according to FIG. 4.
Figure 6:
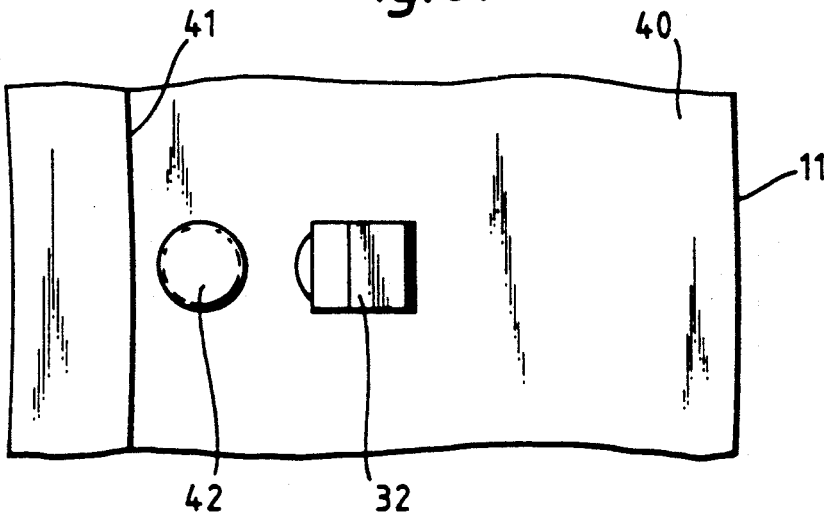
FIG. 6 the plan view of a lock support of the lock arrangement according to FIGS. 2 and 3 with the segment removed.

To align the segment 14 on the lock support 11 the latter advantageously has a flat surface 40, a first abutment surface 41 perpendicular thereto (FIG. 2) and a centring pin 42 projecting perpendicularly from the surface 40, while the segment 14 has a bearing surface 43, e.g. forming its underside, cooperating with the flat surface 40 (FIG. 2) and a second abutment surface 44 (FIG. 2) cooperating with the first abutment surface 41. Moreover the segment 14 is provided with a recess 45 (FIG. 5) on its side facing towards the second abutment surface 44 and extending to the bearing surface 43, serving mainly as a guide groove and which has a width corresponding precisely to the diameter of the centring pin 42.

To simplify the construction the first claw 32 projects above the flat surface 40, while the second claw 33 is arranged wholly within the recess 45. In this respect the second claw 33 advantageously has a width corresponding substantially to the width of the recess 45 (FIG. 5), so that it is on the one hand mounted with adequate play and is thus easily movable up and down, but on the other hand cannot turn with the tightening nut 38 on rotation thereof, but maintains the orientation on the segment 14 apparent from FIGS. 2 and 3.

According to an especially preferred embodiment the two claws 32 and 33 are provided at their free ends with hooked or claw-like elements 46 and 47 respectively (FIG. 2), which match each other are preferably open towards opposite sides and each towards their pins 34 and 36 respectively. The element 46 of the first claw 32 is arranged more in the vicinity of the upper end of the recess 45, while the element 47 projects more in the direction of the plane of the bearing surface 43.

Figure 2:
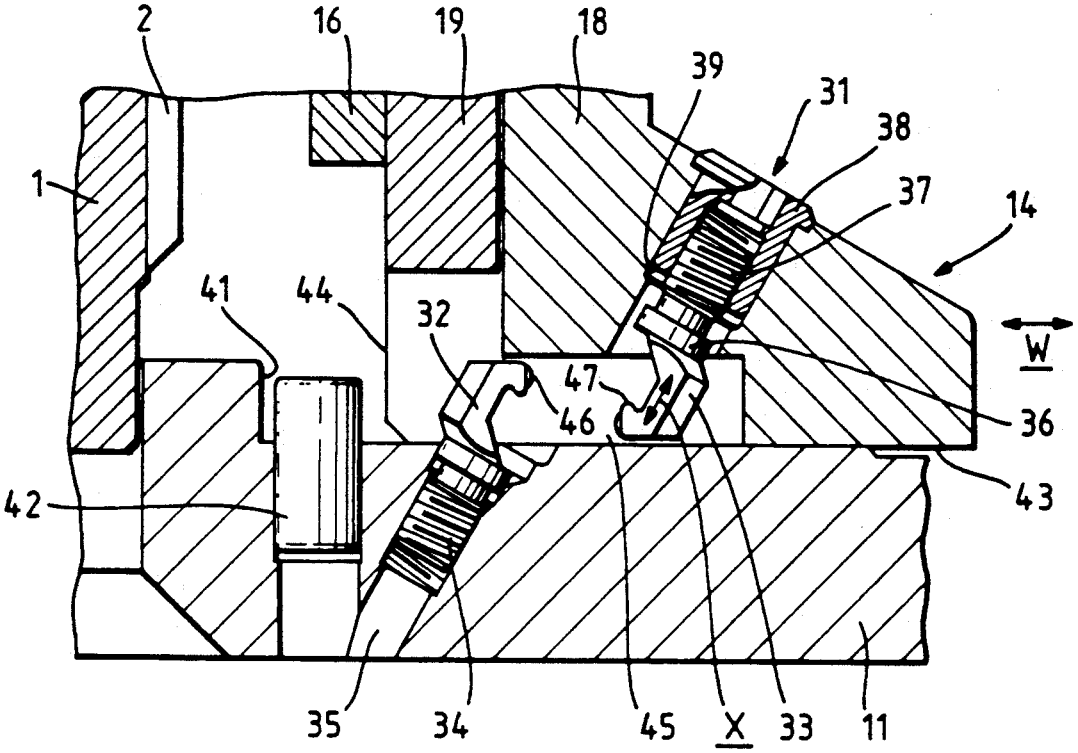
FIGS. 2 and 3 each an enlarged section of FIG. 1 with the quick connector released and coupled up respectively.
Figure 4:
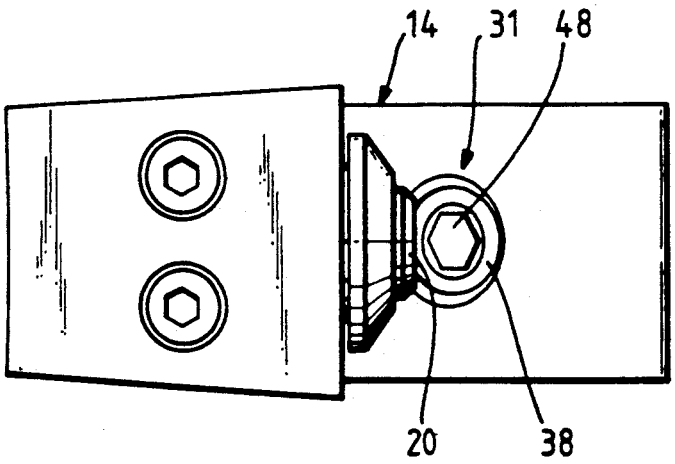
FIG. 4 a plan view of a segment of the lock arrangement according to FIGS. 2 and 3.

The fixing arrangement 31 according to the invention operates in essence as follows:

In the demounted state the second claw 33 is in the lowered state apparent from FIG. 2. The segment 14 to be mounted is placed with its bearing surface 43 on the surface 40 of the lock support 40 and is pushed in the direction of the needle cylinder 1 parallel to an arrow w, until its abutment surface 44 strikes the abutment surface 41. The centring pin 42 engages in the recess 45. The segment 14 is accurately positioned and aligned in all directions in this location, radially by the abutment surfaces 41 and 44, in the circumferential direction by the recess 45 and the centring pin 42 and in height by the flat surface 40 and the bearing surface 43, so that this applies also for the positional accuracy of the lock part (e.g. 16) mounted thereon. In this position the two claws 32 and 33 engage in one another, whereby the hooklike element 47 comes to lie under the hooklike element 46 in the embodiment. Then the tightening nut 38 is turned with the aid of a suitable tool, e.g. an allen key, which fits in a hexagonal recess 48 (FIG. 4) of the tightening nut 38, and the claw 33 is thereby displaced in the direction of an arrow x, so that the two hook-shaped elements 46 and 47 engage ever further in each other like clamps and are firmly tightened together. The claw 33 and the coupling pin 36 thus act as a tensioning element. The segment is now clamped on the lock support 11 and both claws 32 and 33 are located in the recess 45.

If the segment 14 is later to be released, in order for example to exchange it for another segment or to change the lock part 16 for another lock part, the steps recited need merely be carried out in reverse order.

Figure 3:
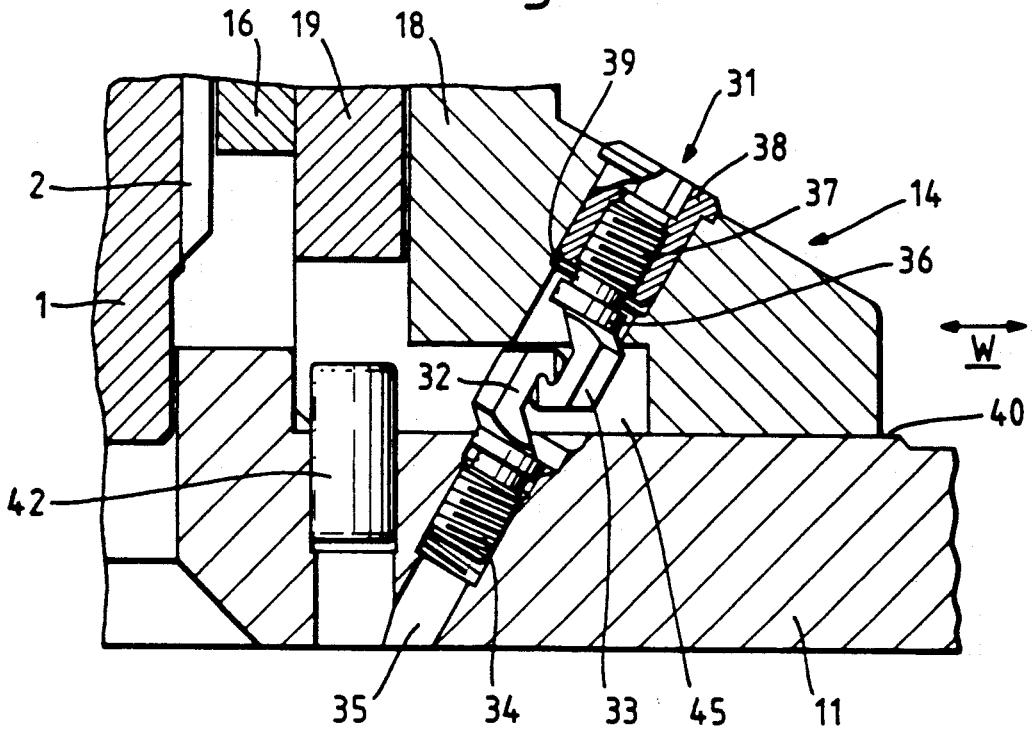

As is apparent from FIGS. 2 and 3, an especial advantage consists in that, in the undoing or tightening up of the described quick connector, the path of adjustment of the two claws 32, 33 relative to each other can be made very small. Therefore the tightening nut 38 needs only to be turned through one or at the most two turns. If the fixing is effected solely by clamping or tightening the two claws 32, 33 against each other, i.e. without the hook-shaped elements 46, 47, the necessary adjustment can be made even smaller. It is further advantageous in this that the threaded part of the coupling pin 36 and the tightening nut 38 effect a high degree of self-locking, especially with small pitch angles, so that the connection holds reliably on account of the large frictional forces even on the occurrence of vibrations. Finally, tolerance differences are largely unimportant, because they can be compensated for by suitable shifting of the coupling pins.

With particular advantage, the pin 34 and the coupling pin 36 are coaxial and at such an angle to the surfaces 40, 41, 43 and 44 that, on tightening the tightening nut 38, the bearing surface 43 is drawn against the surface 40 and at the same time the abutment surface 44 is drawn against the abutment surface 41. In this way the required positioning of the segment 14 is not affected by the fixing device 31.

The invention is not limited to the described example, which can be modified in numerous ways. For example it is possible to provide a corresponding fixing device for fixing the sinker segment 15 on the lock support 12, or a ribbing lock segment on a ribbing lock support or a segment on the carriage of a flat knitting machine. Furthermore, it would be conceivable to mount the claw 32 on the lock support 11 adjustable in the axial direction of the pin 34 and to mount the claw 33 fixedly on the segment 14 and/or to arrange the claws 32 and 33 in a recess formed in the lock support 11. Also an adjustable or free mounting of both claws is possible. For example the first claw 32 could be drawn by the second claw 33 against a fixed abutment. Furthermore it would be possible to form the first claw 32 as an annular groove formed in the lock support 11. In this it is understood that the axes of the pins 34, 36 as well as the claws 46, 47 of the claws 32, 33 could moreover assume different angles to the axes of the pins 34, 36. Also different depths of the claws 46, 47 could be provided. According to a particularly preferred embodiment it is moreover provided that all adjustable pins (34 and/or 36) of the cylinder, ribbing or sinker lock are connected to a common setting ring, which is formed as a threaded or clamping ring and makes possible the common releasing or tightening up of all associated segments. Finally means other than those shown in the drawing could be provided for positioning the segments on the lock support.

While the invention has been illustrated and described as embodied in a large diameter circular knitting machine having knitting needles in the cylinder and sinkers in the sinker ring, it is not intended to be limited to the details shown, since various modifications and structural changes may be made without departing in any way from the spirit of the present invention, particularly with respect to other circular and flat knitting machines.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Cam arrangement for a knitting machine, especially a circular knitting machine, comprising: a first support in the form of a cam support, said cam support having a flat surface (40), a first abutment surface (41) perpendicular thereto and a centering pin (42) projecting from the flat surface (40); at least one second support in the form of a segment (14), said second support having a bearing surface (43) cooperating with the flat surface (40), a second abutment surface (44) cooperating with the first abutment surface (41) and a recess (45) receiving the centering pin (42); at least one cam part (16) mounted on the segment and at least one fixing device (31) for interchangeable fixing both supports (11, 14) on each other, said fixing device (310) including a first claw (32) associated with one of said supports and tightening means associated with the other one of said supports, said tightening means including a coupling pin (36) associate with the other support and having a second claw (33) cooperating with the first claw (32) and a threaded section (37), said tightening means also including a tightening element (38) screwed together with the threaded section (37) and rotatably mounted on the support to which the coupling pin (36) is associated.

2. Cam arrangement according to claim 1, wherein the other support to which the coupling pin (36) is associated, is provided with a bore (39), the tightening element (38) being rotatably mounted in the bore (39).

3. Cam arrangement according to claim 1, and further comprising a mounting pin (34) fixedly mounted in the one support to which the first claw (32) is associate, the first claw being fixed on the mounting pin.

4. Cam arrangement according to claim 3, wherein the coupling pin (36) is mounted on the other support (14) to which it is associated.

5. Cam arrangement according to claim 1, wherein the first claw (32) projects from the flat surface (40), the first and second claws (32, 33) projecting into the recess (45), the recess (45) bordering on the bearing surface (43) and the second abutment surface (44).

6. Cam arrangement according to claim 1, wherein the coupling pin (36) is mounted at such an angle in the other support (14) to which it is associated that, on tightening the tightening element (38), the bearing surface (43) is drawn against the flat surface (40) and at the same time the second abutment surface (44) is drawn against the first abutment surface (41).

7. Cam arrangement according to claim 1, wherein the two claws (32, 33) are provided with hook-shaped, inter-engaging elements (46, 47).

8. Cam arrangement according to claim 7, wherein the hook-shaped, interengaging elements (46, 47) are open to opposite sides.

9. Cam arrangement according to claim 1, wherein the coupling pin (36) is mounted non rotatably, but axially displaceable on the other support (14) to which it is associated.

10. Cam arrangement according to claim 1, wherein the threaded section (37) is an externally threaded section and the tightening element (38) is a tightening nut.

11. Cam arrangement according to claim 1, wherein the threaded section (37) is an internally threaded section and the tightening element (38) is a tightening screw.

12. In a cam arrangement for a knitting machine, especially a circular knitting machine, said knitting machine having one support (11) in the form of a cam support, at least one other support (14) in the form of a segment, at least one cam part mounted on the segment and at least one fixing device (31) for interchangeable fixing of the one support on the other supports, the fixing device (31) including a first claw associated with the one support (11) and a tightening means including a coupling pin (36) associated with the other support (14), the coupling pin (36) having a second claw (33) cooperating with the first claw (32) and a threaded section (37) and the tightening means also includes a tightening element (38) screwed together with the threaded section (37) and rotatably mounted in the associated other support (14), the first claw (32) being fixed on a mounting pin (34) fixedly mounted in the other support (11), the mounting pin (34) being mounted in the one support (11) and the coupling pin (36) being mounted on the other support (14). the one support (11) having a flat surface (40), a first abutment surface (41) perpendicular thereto and centring pin (42) projecting from the flat surface (40), and the other support (14) having a bearing surface (43) cooperating with the flat surface (40), a second abutment surface (44), cooperating with the first abutment surface (41) and recess (45) receiving the centring pin (42).

13. The improvement as defined in claim 12, wherein the first claw (32) projects from the flat surface (40), the first and second claws (32, 33) project into the recess (45) and the recess (45) borders on the bearing surface (43) and the second abutment surface (44).

14. The improvement as defined in claim 12, wherein the coupling pin (36) is mounted at such an angle in the other support (14) that, on tightening the tightening element (38), the bearing surface (43) is drawn against the flat surface (40) and at the same time the second abutment surface (44) is drawn against the first abutment surface (41).

* * * * *